US005823356A

United States Patent [19]

Goodrich et al.

[11] Patent Number: 5,823,356

[45] Date of Patent: Oct. 20, 1998

[54] APPARATUS AND METHOD FOR INSEPCTING THREADED MEMBERS

[75] Inventors: Lloyd Goodrich, Roseville; James F. Carpenter, Macomb; Gregory J. Wronkowicz, Sterling Heights, all of Mich.

[73] Assignee: Ajax Metal Processing, Inc., Detroit, Mich.

[21] Appl. No.: 637,424

[22] Filed: Apr. 25, 1996

[51] Int. Cl.[6] ..... B07C 5/12

[52] U.S. Cl. ..... 209/601; 209/929

[58] Field of Search ..... 209/601, 600, 209/604, 929, 539

[56] References Cited

U.S. PATENT DOCUMENTS

| | | |
|---|---|---|
| 2,234,456 | 3/1941 | Schaurte et al. . |
| 2,378,711 | 6/1945 | Kuehlman . |
| 3,613,882 | 10/1971 | Stampe . |
| 3,709,328 | 1/1973 | Mohr et al. . |
| 3,731,795 | 5/1973 | Velthoven . |
| 3,739,908 | 6/1973 | Gunther . |
| 3,743,091 | 7/1973 | Fowlkes . |
| 3,743,093 | 7/1973 | Klancnik . |
| 4,095,475 | 6/1978 | Buckley . |
| 4,200,921 | 4/1980 | Buckley . |
| 4,287,769 | 9/1981 | Buckley . |
| 4,341,311 | 7/1982 | Gold et al. . |
| 4,457,622 | 7/1984 | Kato et al. . |
| 4,557,386 | 12/1985 | Buckley et al. . |
| 4,576,286 | 3/1986 | Buckley et al. . |
| 4,677,852 | 7/1987 | Pinyan et al. . |
| 4,690,284 | 9/1987 | Buckley et al. . |
| 4,735,088 | 4/1988 | Pinyan et al. . |
| 4,831,251 | 5/1989 | Hanna . |
| 4,905,842 | 3/1990 | Hebele et al. . |
| 5,139,150 | 8/1992 | Fuller, Jr. et al. . |
| 5,160,978 | 11/1992 | Faville . |
| 5,165,551 | 11/1992 | Frost . |
| 5,246,117 | 9/1993 | Zivley . |
| 5,310,064 | 5/1994 | Neff et al. . |
| 5,383,021 | 1/1995 | Hanna . |

*Primary Examiner*—David H. Bollinger
*Attorney, Agent, or Firm*—Vanophem Meehan & Vanophem, P.C.

[57] ABSTRACT

An inspection device for inspecting production threaded members wherein the threaded members are routed to a test station to functionally inspect the thread profile of each threaded member to ensure that when the threaded member is matched with a corresponding threaded hole in an engine block or, in the alternative, a threaded nut, the threaded member will mate properly to serve its intended purpose.

9 Claims, 3 Drawing Sheets

APPARATUS AND METHOD FOR INSEPCTING THREADED MEMBERS

BACKGROUND OF THE INVENTION

1. Field of the Invention

The present invention relates to an apparatus and method for inspecting the thread of any threaded member, and particularly the threads on a bolt or screw. Specifically, the present invention relates to an apparatus and method for performing a functional test by a thread inspection device having a parts feeder and transfer means for sequentially transferring threaded members through a predetermined transfer path while maintaining the threaded members in a predetermined orientation for functional testing of the thread and subsequent sorting of the non-functional threaded members from the functional threaded members.

2. Description of the Prior Art

Heretofore, one of the principal costs in the production of threaded fasteners has been the manual and visual inspection and sorting of dimensionally defective threaded fasteners from the large volume automatic-machine production of such threaded fasteners. Threaded fasteners such as threaded bolts are normally made on high volume, high speed automatic cold heading machines. Production is often at the rate of several thousand pieces per hour. Initially, in order to select from such high volume production, those threaded fasteners which contain dimensional defects including failure to tap or thread the shaft, severely deformed threads resulting from any number of manufacturing problems, or for any other reason wherein the threaded shaft is unduly or unusually misshapened or is of improper dimensional characteristics, manual and personal inspection is required and the associated costs constitutes a substantial part of the cost of production. In addition, personal or manual inspection is not only cost prohibitive but not always reliable, particularly as required for and by the large volume users of threaded fasteners such as manufacturers in the automotive industry. To accommodate these requirements, sampling programs were implemented with reasonable success for monitoring the quality of the production volume of threaded fasteners. However, recent zero defect demands of very high quality control for threaded fasteners constitute a major requirement by the end user and have resulted in the requirement that the supplier inspect 100 percent of every threaded fastener prior to shipping to the end user. Such requirements have clearly superseded the sampling techniques that were prevalent in the industry and demanded that provisions be made for 100 percent inspection of threaded fasteners utilized in critical components such as engine components as well as transmission and drive train components.

These and other factors have resulted in a vital and increasing need to enable evaluation of all critical dimensional criteria of individual threaded fasteners by the supplier to ensure defective threaded fasteners are removed before shipment. Statistical sampling is no longer an acceptable testing technique.

To attempt to provide 100 percent inspection of threaded fasteners, numerous systems based on optics and acoustics were developed and are presently known for dimensionally qualifying each and every threaded fastener produced. Typically, a plurality of threaded fasteners are advanced along the fabrication line by means of physically engaging the extended flanges of a headed portion and a gripping mechanism and sequentially feeding the threaded fasteners through an examination station, whereby each threaded fastener is subjected to a dimensional qualification. After the threaded fastener is examined, it is subsequently discharged from the machine in either a "reject" receptacle, or, if conforming, into an "accept" receptacle.

Various non-contact inspection systems are also known using various techniques. For example, ultrasonic inspection systems examine reflective sound waves as a means of characterizing a component. Various systems based on a video image of a part are also known. In addition, laser gaging systems are used in which specific dimensional measurements can be obtained. Inducing eddy currents to characterize dimensional characteristics is also a known prior art gaging system for the examination of threaded fasteners.

In general, however, although known non-contact inspection systems are extremely useful, they all have certain limitations. Many of the available non-contact gaging systems are complex data processing approaches which impose expensive hardware requirements and can limit the speed with which evaluations can be accomplished. Preferably, evaluation of a workpiece can be conducted in a rapid enough fashion that the parts can be directly sorted into qualified or disqualified part streams. Prior art systems also tend not to be easily adapted to various part configurations or for evaluating different features of a part. Moreover, many of the currently available non-contact inspection systems have limitations in terms of the number of parameters which can be effectively examined during the inspection process. Another disadvantage of some known systems is their limitation in terms of types of parameters which can be considered. For example, often fine details of thread profiles of threaded fasteners are required to be inspected. Moreover, many prior art systems, although performing adequately in laboratory settings, are not sufficiently rugged for production environments where temperature variations, dust, dirt, cutting fluids, etc. are encountered.

Further, the many defects as characterized by dimensional characteristics of what seems to be a rather simple item combined with the speed at which these threaded fasteners are produced in production presents a challenging problem to ensure 100 percent inspection. For example, a threaded fastener such as a threaded bolt is instructive to consider in this regard. The length of the bolt head and of the cylindrical shank on which threads are formed are each important characteristics which on given designs may, for example, need to be within a minimum and maximum dimension. If the bolt has a hex head, the presence of properly defined corners on that head are important to enable the use of a wrench with that threaded fastener. Some designs incorporate a punched out void area in the center of the head, for use with socket or similar interior wrench devices. These voids need to be cleared of waste metal to ensure usefulness of the threaded fastener; an incomplete void may prevent the bolt from being installed in its intended location. Additionally, head diameter, shoulder thickness, length of thread, etc. are but some of the dimensions that must meet certain prequalified tolerance requirements. Further, damaged threads due to handling or incomplete production processing are defects which may occur even if the bolt is otherwise completely within all dimensional tolerances.

In all of the prior art applications and specifically with respect to gaging of threaded members, none of the known gage inspection or gaging systems provide any information with respect to detail defects within the thread profile. That is, threads may become damaged as a result of handling especially since such threaded fasteners are handled in bulk containers. Therefore, many threaded fasteners which are passed by the so called 100 percent inspection systems often have nicks within the thread which go undetected through the inspection system and are reported as an acceptable part, when in fact the nick in the thread will prevent the threaded bolt from being assembled to a complementary threaded nut. The reason that such defects are undetectable by the sophisticated prior art laser systems is because most of the systems verify dimensional checks such as outside diameters, shaft diameter, shoulder location relative to an end, head height, overall length etc. Notwithstanding the correctness of all of these dimensional characteristics, none of the prior art systems ensure that the thread has not been damaged so that it will properly function with a complementary threaded hole or threaded nut.

In U.S. Pat. No. 3,743,091, there is proposed an apparatus and method for automating the final inspection as to the pitch diameter of the thread so that screws with two or more different threads can be separated and properly sorted from a batch of mixed parts. This inspection is accomplished by presetting the mixed parts in seriatim at a separating station and alternatively moving the parts past at least two gage heads serving as a go/no-go gage. If the thread of the screw matches with the contour of the first gage head, then the screw will be ejected by the kicker to a first receiving bin. If there is a no-go condition (no match) at the first gage head, then the part is redirected and urged for movement past a second gage head whereby the part is deposited in a second receiving bin. In the event that neither gage head corresponds to the threads of the screw being tested, the screw may, in accordance with one embodiment of the invention, be removed from the gaging station along a separate path so that the sorting operation may continue unimpeded.

In spite of the fact that the teachings of U.S. Pat. No. 3,743,091 are concerned with testing for pitch diameter, so as to enable sorting of mixed threaded parts, it can be noted from FIG. 5 that such testing is limited strictly to a cross-sectional outline of the threaded part being matched with the gage head of the testing device. Accordingly, again, any nicks or damage within the thread may not necessarily be caught and a thread which properly meets the condition of the go/no-go gage of the invention may still be unable to be utilized in conjunction with a complementary threaded bore or threaded nut for which it is intended.

Accordingly, there has been a long felt need in the art for a machine that would automatically functionally check the screw thread of a threaded shaft to ensure that when that screw thread was matched with a corresponding hole in an engine block or in the alternative, a threaded nut, there will be no question that the two will properly be allowed to mate and perform the intended function. No solution currently exists for solving the above-identified problem. Accordingly, what is needed is a 100 percent mechanized inspection device which will ensure the functionality of a thread found on a threaded shaft with a complementary female thread in the bore of a hole or in a nut such that the threaded fastener may serve its intended purpose.

SUMMARY OF THE INVENTION

In accordance with the present invention, a method and apparatus for functionally testing and sorting threaded members during the fabricating process is provided. The apparatus of the invention is formed as a single inspection device in which production parts are continuously supplied and serially moved into a test station wherein the threaded profiles of the production parts are functionally tested. Further, a plurality of laser sensors are disposed along the transfer path through the inspection device to perform predetermined measurements of specified dimensional characteristics of the production parts. The output of the functional test as well as from the laser sensors is compared with a predetermined tolerance limit so that a predetermined acceptance/unacceptance signal is generated in the form of a sorting signal and communicated to a sorting device disposed closest to the end of the transfer path through the device to separate defective parts from nondefective parts.

In a preferred embodiment of the method and apparatus for sorting threaded members, a frame support is mounted to a base member. A slotted input rail receives threaded members from a supply container and delivers a plurality of threaded members to a first rotatable transfer or escapement wheel attached to the frame in order to advance the threaded members one at a time from one end of the inlet area and rotatably transfer each of the members one at a time to a predetermined drop-off area. A second rotatable transfer wheel or regulator wheel is attached to the frame support and spaced relative to the escapement wheel such that the threaded fasteners carried by the first rotatable transfer wheel are conveyed to the drop-off area and transferred to the second rotatable transfer wheel. The second rotatable transfer wheel holds the fastener magnetically along its peripheral edge and carries the threaded fastener to a test station. At the test station, the threaded fastener is tested for selective dimensional characteristics as well as for functionally operating according to its intended purpose. While the threaded fastener is in the test station, designated lasers are placed surrounding the test station in order to check dimensional characteristics such as length, head height, flange diameter, etc. as well as to functionally test the thread profile of the production fastener. The functional test of the threaded fastener is accomplished by providing a slide mechanism which carries a master thread gage. A second slide mechanism carries a plurality of guide rollers. As the threaded fastener is moved by the regulator wheel to the test position, an appropriately placed sensor signifies to the slide mechanism that a threaded fastener is incoming to the test station whereupon the second slide mechanism containing the guide rollers is moved towards the regulator wheel in order to allow the fastener to abut the rollers. The threaded fastener can no longer move circumferentially upon abutting the guide rollers so that the fastener begins to roll or rotate about its longitudinal axis along the peripheral edge to the regulator wheel while under the magnetic influence of the regulator wheel. Subsequently, the first slide mechanism having a master thread gage at the front thereof is moved in the direction toward the threaded fastener so as to allow the guide rollers and master thread gage as well as the regulator wheel to provide a nest for the threaded fastener in the test station. The master thread gage is an identical thread to that found on the threaded fastener but manufactured to very close dimensional tolerances so that dimensionally all dimensions are at a mean condition of the part print dimensions. Therefore, the pitch diameter of the threaded profile on the master thread gage is at its mean dimension and after engaging the profile of the part to be tested any deviation in the thread profile of the threaded fastener is detected by a laser sensor which is calibrated from a datum position and takes into account the allowable tolerance in pitch diameter as depicted on the part print.

Since the regulator wheel rotates at a constant speed, the threaded fastener is caused to rotate at a constant speed in the test station. After engagement, the thread profile of the master thread gage is forced to follow the thread profile of the threaded fastener for its full length. In following the thread profile of the threaded fastener for its entire length, the tolerance variation of the pitch diameter of the thread profile of the fastener will be reflected by the in and out movement of the thread profile of the master thread gage, that is, as the tolerances of the thread profile of each of the threaded fasteners differs the master thread gage will engage each threaded fastener at a different point. Accordingly, by providing a mean start position or datum point an upper and lower limit (the part print tolerance) for the permissible movement of the master thread gage with respect to the mean dimension can be determined. Any movement outside of these limits is evidence of a defect, i.e. nick, gouge, burr, etc. or some type of a deformity in the thread. Accordingly, proper complementary engagement of the complementary thread profiles between the threaded fastener and the master thread gage will not be possible and such arrangement is considered an unacceptable part. If the movement of the master thread gage is outside of the tolerance limits a signal will be generated to reject such a part. Following the residence of the threaded fastener in the test station for a predetermined amount of time, a signal is generated indicating whether such part is acceptable or unacceptable. Thereafter, both the guide rollers and master thread gage are retracted by their respective slide mechanisms and the magnetic regulator wheel will carry the threaded fastener to a discharge location. At the discharge location an indexing stripper removes the threaded fastener from the regulator wheel and indexes the threaded fastener to a position near the inlet of a slotted discharge rail. A solenoid operated rotatable door for sorting the acceptable threaded fasteners from the unacceptable threaded fasteners is mounted along the slotted discharge rail. The rotatable door moves into the traveling path of the threaded fastener discharged along the slotted discharge rail to allow the threaded fastener to be sorted into a reject receptacle upon receiving the appropriate reject signal from the testing station. If there is no reject signal, the threaded fastener is allowed to travel down the slotted discharge rail into a storage bin which represents acceptable threaded fasteners.

The apparatus of the invention is adapted to sort acceptable and unacceptable threaded parts by a method that includes the steps of:

serially placing the plurality of threaded members one at a time at a predetermined pick-up area on a first rotatable transfer wheel carried by the frame support which is mounted to a base member;

transferring each of the threaded members from the predetermined pick-up area to a second rotatable transfer wheel mounted to the frame support for serially moving each of the threaded members to at least one test station;

functionally testing the threaded profile of each of the threaded members by rotating each threaded member while located in the test station in complementary engagement with a master thread gage;

monitoring the master thread gage for movement while the master thread gage is engaged with the threaded portion of the threaded member to generate a control signal indicative of the accuracy of the thread of each threaded member as compared to the master thread gage;

discharging the threaded member from the second rotatable transfer wheel into a discharge rail at a predetermined discharge area; and sorting each defective threaded member discharged on the discharge rail from the nondefective threaded members upon receiving the control signal from the monitoring device.

DETAILED DESCRIPTION OF THE PREFERRED EMBODIMENT

Figure 1:
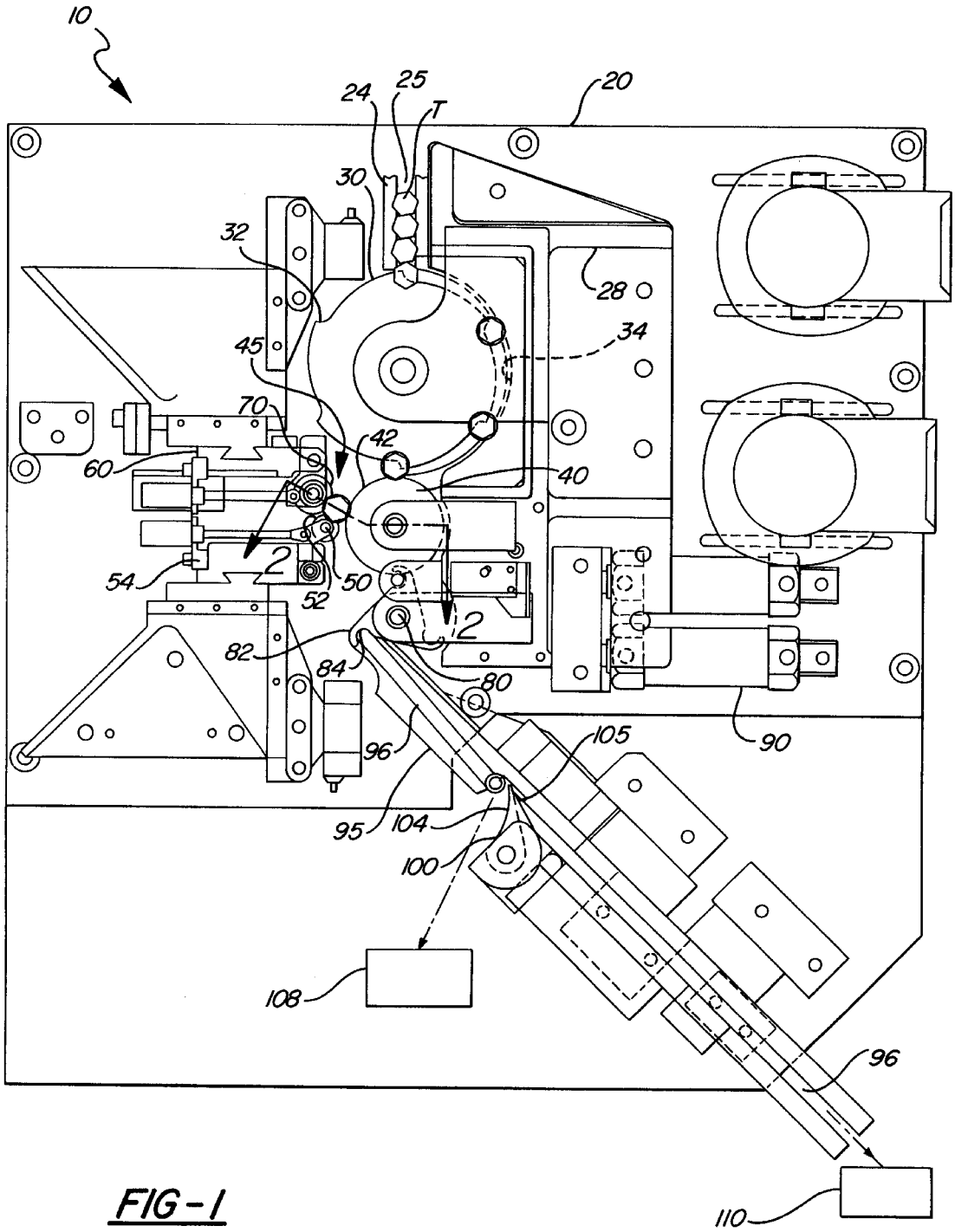
FIG. 1 is a plan view of the inspection device.

With reference to FIGS. 1 through 5 there is shown an inspection device 10 for functionally and dimensionally testing threaded members and, specifically, in the preferred embodiment, production threaded fasteners T wherein a continuous path is established for the threaded fastener to follow. While along this path the threaded fastener encounters a test station for functionally testing the helical thread thereon as well as for inspecting various dimensional characteristics, if required. The device lends itself to checking dimensional characteristics of the threaded fastener at any convenient place along the path which the threaded fastener T travels in the inspection device.

The inspection device 10 is an assembly of three basic structural component assemblies mounted to a frame support 28 on a base 20. A threaded fastener delivery system for conveying threaded fasteners to a functional test station 45; a test station component for functionally and, if desired, dimensionally checking the threaded fasteners while they are located in the test station; and a discharge or unloading component for discharging the threaded fasteners as a function of the functional test performed while the threaded fastener is in the test station or, in addition, based on the results of any dimensional testing which may occur while the threaded fastener travels along the path through the inspection device. The functional test compares a master thread gage 70 with the actual production thread profile fabricated while the dimensional characteristics of the threaded fastener are compared to an allowable tolerance variation as specified on the part print for the specific threaded fastener T tested.

The inspection assembly 10 consists of a supply container (not shown), whose construction is known from the prior art, and which contains the bulk threaded members or, as in the preferred embodiment, a threaded fastener T formed with a head, shank and a thread form thereon. The supply container may be located adjacent the inspection assembly or can be directly mounted to the base 20. The threaded fasteners T are discharged in seriatim onto a slotted inlet rail 24 from which the threaded fasteners are suspended. Because the head diameter is larger than the width of a slot 25 of the slotted inlet rail, the fasteners slide along the rail with the underside shoulder of the head portion while the shank of the threaded fastener is guided by the slot 25 in the rail. The slotted inlet rail 24 is inclined downwardly so as to permit gravity to impart a substantially constant rectilinear movement in the direction of transportation. Note that there is realistically no limit as to the length of the threaded fastener which can be transported by the slotted inlet rail 24 since the overall length of the shank is only limited by the height of the frame support 28 mounted on the base 20. The slotted inlet rail 24 terminates near an escapement or transfer wheel 30 which is mounted to the frame support 28 located on the base 20. The escapement wheel 30 is attached to an upright shaft (not shown) having an opposite end driven by a motor through a gear box (not shown) all of which are mounted on the frame support 28. The escapement wheel 30 has on its outermost periphery, formed in a generally circular configuration, a plurality of cog-like indentations 32 at equally spaced locations along the outer periphery of the escapement wheel. The cog-like indentations 32 are for the purpose of receiving the threaded fasteners T from the slotted inlet rail 24 and rotatably transferring the threaded fasteners along a circular slotted guide 34 (similar to the slotted inlet rail 24) provided between the escapement wheel 30 and a portion of the frame support 28 so as to move the threaded fastener T from the slotted-inlet rail 24 to a position adjacent a rotatable transfer or regulator wheel 40 which in the preferred embodiment is magnetic so that the threaded fastener T can be magnetically held along a peripheral edge 42 of the regulator wheel 40 for a reason to be explained hereinafter.

The regulator wheel 40 is mounted to the frame support 28 adjacent the escapement wheel 30 to permit the transfer of the threaded fastener, as it is rotated by the escapement wheel 30 through the circular slot 34 and in the proximity of the regulator wheel. The magnetic force of the regulator wheel 40 pulls or unloads the threaded fastener from the escapement wheel 30 and positively locates the threaded fastener T along the peripheral edge 42 of the regulator wheel 40. The regulator wheel 40 rotates at a constant speed in a direction opposite to that of the rotation of the escapement wheel 30 and the unloading of the threaded fastener T from the escapement wheel 30 is facilitated by the cog-like indentations 32 along the peripheral edge of the escapement wheel 30. The driving force for the regulator wheel is a motor and gear box (not shown) mounted to the frame support 28 in a manner well known to a person ordinarily skilled in the art. The mass of the threaded fastener T and the speed at which the threaded fastener is moved through the inspection device may, in the alternative, dictate the use of a pressure wiper device (not shown). If the threaded fastener, as it is carried by the escapement wheel 30 exhibits any tendency for movement as a result of any vibrations, the positioning of the threaded fastener T on the regulator wheel 40 can be positively established by the use of a pressure wiper which is mounted above the regulator wheel 40 at a location where the threaded fastener is magnetically transferred to the regulator wheel 40. The pressure wiper ensures positive location of the threaded fastener on the regulator wheel 40 by placing a slight pressure on the top side of the head of the threaded fastener T in a downward direction, towards the regulator wheel, so that a firm contact is established by the underside of the head portion of the threaded fastener with the top side of the regulator wheel 40. The magnetic holding force will maintain such location as the threaded fastener continues along its transfer path. The regulator wheel continuously rotates at a preselected constant speed opposite to the rotation of the escapement wheel 30 in order to ensure the smooth transition of the threaded fasteners from the escapement wheel 30 to the regulator wheel 40 as well as in order to provide rotatable motion necessary to functionally check the threaded profile on the threaded fastener as will be explained hereinafter.

Figure 2:
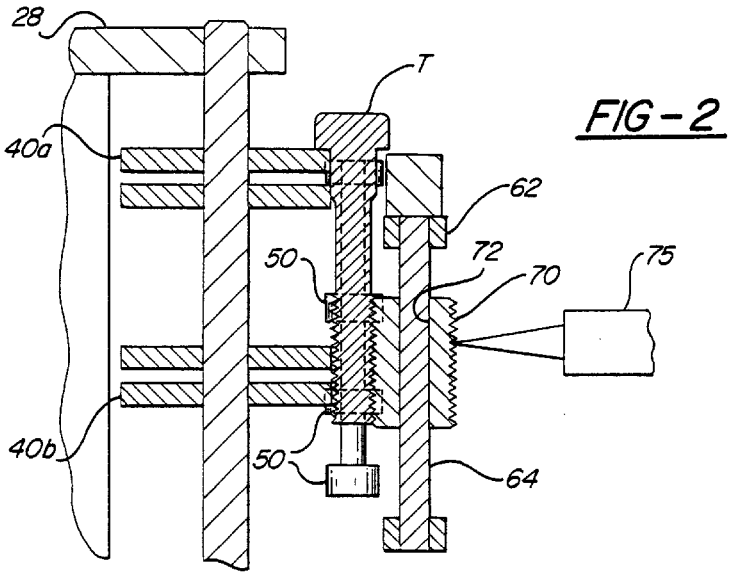
FIG. 2 is a partial offset cross-sectional view taken along lines 2—2 of FIG. 1.
Figure 4:
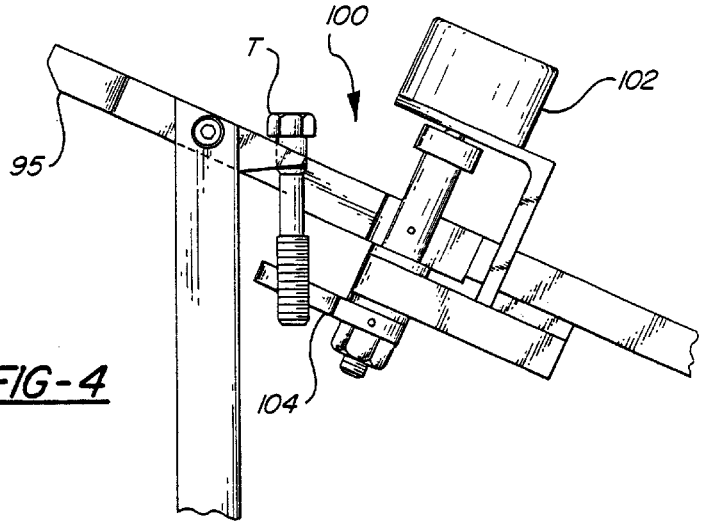
FIG. 4 is a partial view of the slotted discharge rail and solenoid operated door assembly.
Figure 5:
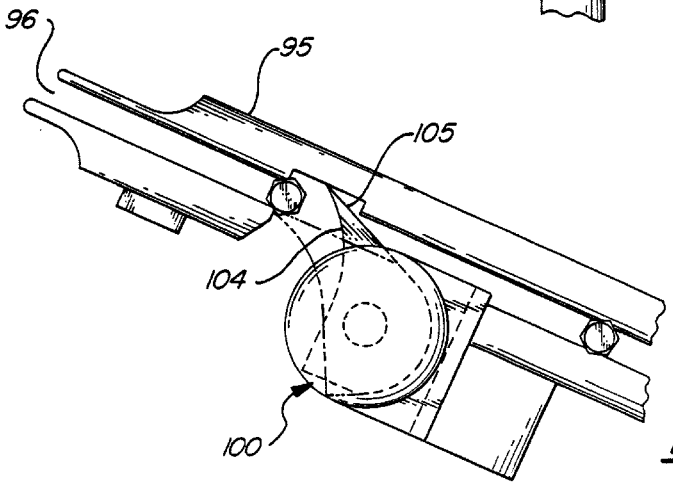
FIG. 5 is a plan view of FIG. 4.
Figure 3:
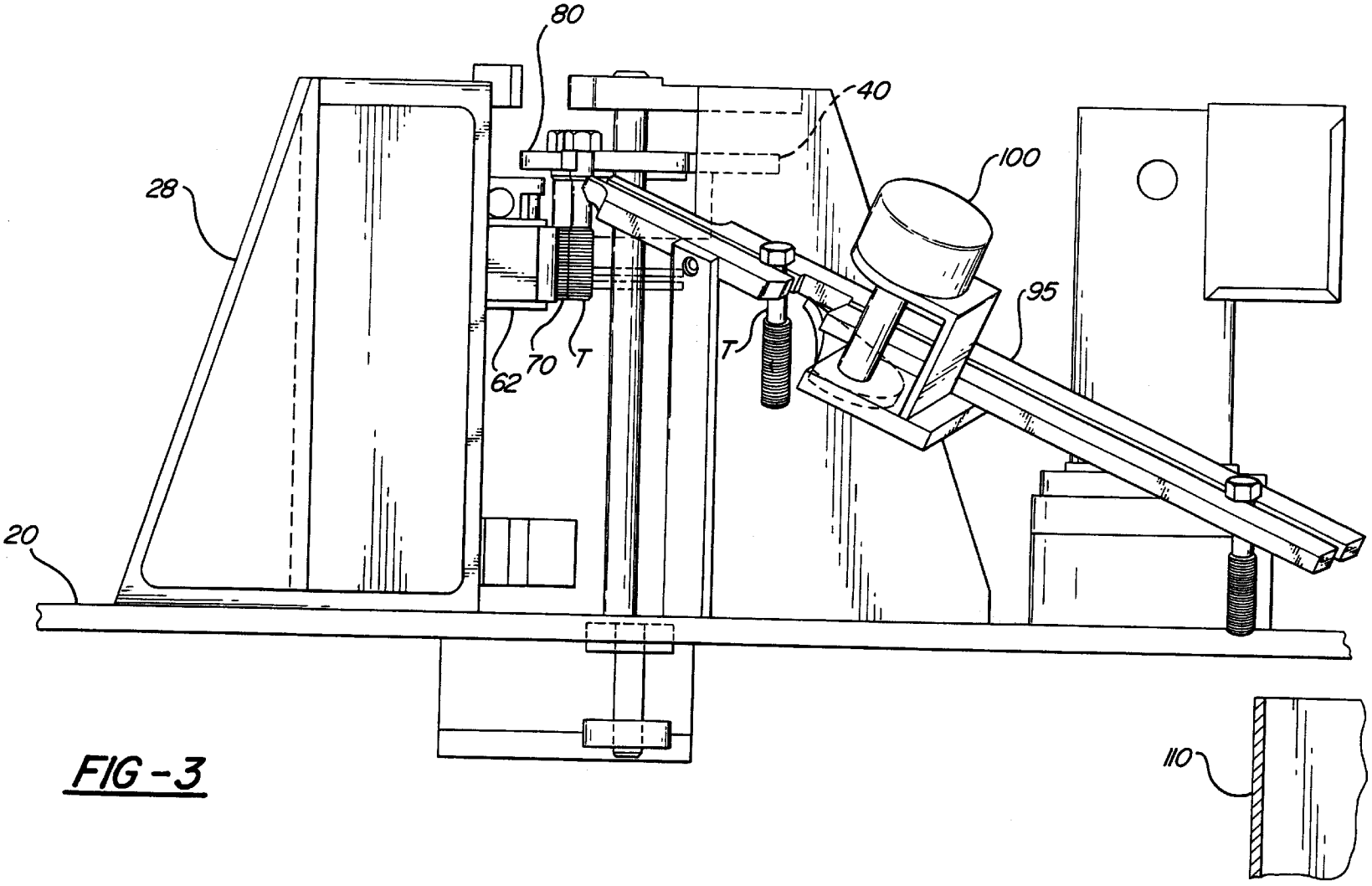
FIG. 3 is a perspective view of the discharge or unloading component assembly.

As stated above, the threaded fastener T is magnetically held to the regulator wheel 40 as the wheel rotates to move the threaded fastener to the test station 45. To ensure the correct orientation of the threaded fastener as well as to ensure that longer threaded fasteners T are positively held in place magnetically during their conveyance through the test station and the functional thread check, the regulator wheel 40 consists of an upper wheel assembly 40*a* and a lower wheel assembly 40*b* (as shown in FIG. 2) so as to support the threaded fastener T along opposing ends of the shank length while the threaded fastener is moved from the escapement wheel 30, where it is unloaded, to the regulator wheel 40 to its ultimate test position. As the regulator wheel 40 rotates and thereby carries the threaded fastener on its periphery to bring the threaded fastener to the test station, the threaded fastener encounters a set of idling rollers 50. The idling rollers 50 are carried by a solenoid operated slide mechanism 54 located opposite the regulator wheel 40. The slide mechanism 54 allows for linear adjustment in the direction towards and away from the regulator wheel 40 as well as in a direction transverse thereto. The idling rollers 50 are adjustable in an up and down direction in order to accommodate different lengths of threaded fasteners.

Before the threaded fastener arrives at the test station 45 the adjustable slide mechanism 54 is activated to move the idling rollers 50 in a position nearby the peripheral edge 42 of the regulator wheel 40. The distance between a peripheral edge 52 of the rollers and the peripheral edge 42 of the regulator wheel 40 must be less than the diameter of the threaded fasteners T since upon arrival of the threaded fastener at the test position the outer peripheral edge 52 of the roller must engage the outer diameter of the shank of the threaded fastener T to stop the threaded fastener from being further conveyed rotatably by the regulator wheel 40 beyond the test position. As the idling rollers 50 abut the threaded fastener T and stop its peripheral rotating travel, the threaded fastener cannot move further circumferentially and, therefore, begins to rotate about its longitudinal axis while located on the outer peripheral edge of the regulator wheel 40 while under the influence of the magnetic attraction of the regulator wheel 40 in the test station 45.

Since the regulator wheel 40 rotates at a constant speed, the threaded fastener T also rotates in the test station at a constant speed. As the circumferential translation of the threaded fastener is stopped and the threaded fastener begins to rotate in place, a second solenoid operated slide mechanism 60 is actuated to move towards the regulator wheel 40. The second slide mechanism 60, like the first slide mechanism 54, moves in a linear direction towards and away from the regulator wheel 40 as well as transverse thereto.

The second slide mechanism 60 has at the forward end thereof a yoke member 62 with a precision spindle 64 mounted between the opposing ends of the yoke member as more clearly shown in FIG. 2. Mounted to the precision spindle is the master thread gage 70. The master thread gage 70 is fabricated with close tolerances to the mean dimensions of the thread profile intended to be inspected and the inner diameter 72 thereof, which mounts to the precision spindle 64, is fabricated for a sliding fit so that the master thread gage 70 can slide along the precision spindle 64 in an up and down direction.

As the second slide mechanism 60 moves towards the regulator wheel 40, the master thread gage 70 engages the thread form of the threaded fastener T and since the threaded fastener T is rotating about its longitudinal axis when the master thread gage 70 engages the thread profile of the thread fastener, the master threaded gage 70 will begin to rotate about its longitudinal axis on the precision spindle 64. As rotation is imparted to the master thread gage 70, the master thread gage 70 is caused to follow the thread form of the threaded fastener in the test station and, therefore, begins to slide up or down the precision spindle 64. The magnetic attraction between the regulator wheel 40 and the threaded fastener T is sufficiently strong to prevent any movement of the threaded fastener along its longitudinal axis. The master thread gage 70 continues to slide along the precision spindle 64 as long as the master thread gage 70 engages the thread profile of the threaded fastener T. During the engagement of the master thread gage 70 with the thread profile on the threaded fastener a complete 360° physical meshing of the opposing threaded profiles occur. Therefore, any defect in the thread profile along the complete longitudinal length of the thread profile on the threaded fastener T will prevent the master thread gage 70 from a mutually complementary engagement of the master thread gage 70 with the threaded fastener.

To detect a defect in the thread profile of the threaded fastener, a laser measuring device 75 is attached to the frame support 28 at a preselected location. The laser sensing or measuring device 75 is calibrated to read on a preselected datum point on the solenoid actuated second slide mechanism 60. This preselected datum position is representative of the mean dimension of the pitch diameter of the respective thread profile on the threaded fastener T being tested.

From this datum point the laser measuring device 75 can read/detect movements of the second slide mechanism 60 in a linear direction either towards or away from the regulator wheel 40. This movement is caused by the interrelationship of the pitch diameters of the two threads (one on the threaded fastener and one on the master thread gage) as they rotate in place in the test station 45. The degree of linear movement is monitored by the laser sensing device 75 and a certain degree of movement on either side of the datum position (a maximum deviation range about either side of the mean datum position) is expected and tolerable since some dimensional deviation in the pitch diameter of the thread profile is allowable as per the part print dimensioning. A threaded fastener T staying within the allowable deviation range of the pitch diameter of the thread profile is considered acceptable. However, if the laser sensing device 75 senses linear movement of the second slide mechanism 60 in excess of the preselected or preprogrammed acceptable tolerance deviation range, such threaded fastener will generate a reject signal and send this signal to the discharge component of the inspection device to separate the rejected threaded fastener from the acceptable threaded fasteners as is hereinafter discussed.

It is readily understood by a person skilled in the art that any defect, i.e. burr, malformation, flaw, etc., within the profile of the thread on the threaded fastener T will cause the master thread gage 70 to be moved outward in a direction away from the regulator wheel 40 resulting in a movement outside of the acceptable deviation range for the pitch diameter dimension which will trigger a reject signal.

After the threaded fastener T has resided in the test station 45 for a predetermined period to ensure adequate functional testing of the mutually engaged thread profiles of the threaded fastener T and the master thread gage 70, and a signal (acceptable or unacceptable) has been generated by the laser sensing device 75, the first solenoid operated slide mechanism 54 carrying the idling rollers 50 at the front thereof is actuated and retracted in a direction away from the regulator wheel 40. As the idling rollers 50 retract with the movement of the first slide mechanism 54 and the abutment condition between the idling rollers 50 and the threaded fastener T magnetically held along the peripheral edge of the regulator wheel 40 disappears, the threaded fastener T will stop rotating along its longitudinal axis and under the influence of the magnetic attraction of the regulator wheel 40 begin to continue to move circumferentially with the regulator wheel 40.

Located adjacent the regulator wheel 40 is an indexing stripper arm mechanism 80 having three equally spaced semi-circular index fingers 82. The index fingers 82 are in the form of an upper and lower finger so that the upper and lower fingers can straddle the regulator wheel in order to act on the threaded fastener T and overcome the magnetic attractive force between the threaded fastener and the magnetized regulator wheel 40 and strip the threaded fastener from the peripheral edge 42 of the regulator wheel 40. The indexing stripper arm mechanism 80 is driven by air activated drive cylinders 90 mounted to the frame support 28. The stripper arm mechanism 80 is mounted to the frame support 28 in spaced relationship to the regulator wheel 40 to ensure easy access by the index fingers 82 to the threaded fastener T to thereby remove the threaded fastener from the peripheral edge 42 of the regulator wheel 40. To facilitate such removal, each of the fingers has a semi-circular depression 84 which forms about the shank of the threaded fastener to "pull" the threaded fastener T and overcome the attractive force between the threaded fastener and the magnetic regulator wheel 40. The threaded fastener is supported on the indexable stripper arm mechanism 80 similar to the support provided by the slotted inlet rail 24 or the circular slotted guide 34 between the frame support 28 and the escapement wheel 30. The underside of the head portion of the threaded fastener rests on the top surface of the index fingers 82 of the stripper arm while the stripper arm indexes the threaded fastener to a position in line with a slotted discharge rail 95 located adjacent and in alignment with the fingers 82 of the stripper arm mechanism 80. The stripper arm rotates to move the threaded fastener T into the slot 96 of the slotted discharge rail 95. The action of stopping the stripper arm mechanism 80 in an aligned position with the slotted rail 95 and the momentum of the threaded fastener T normally results in the threaded fastener being removed from the fingers 82 and placed onto the slotted rail 95. To ensure removal of the threaded fastener from the fingers 82 of the stripper arm mechanism 80 when the stripper arm mechanism 80 is aligned with the slotted discharge rail 95, a small air jet (not shown) is mounted near the discharge slotted rail 95 so that when the finger 82 of the indexing stripper arm mechanism 80 moves the threaded fastener in alignment with the slotted discharge rail 95 the air jet is directed on the threaded fastener to ensure removal of the threaded fastener T from the stripper arm mechanism 80. The slotted discharge rail 95, like the slotted inlet rail 24, is oriented at an angular position with respect to the horizontal so that the gravitational force of the threaded fastener causes the threaded fastener to slide along the slotted discharge rail 95 in a downward direction as clearly seen in FIG. 4.

Along the slotted discharge rail 95 is positioned a solenoid operated rotatable door mechanism 100 having a forward or peripheral portion 105 which constitutes part of the slotted discharge rail 95. Upon receiving a signal from the laser detection device 75 the door mechanism 100 rotates such that the forward portion 105 thereof interferes and interrupts the slotted discharge rail 95 to divert the threaded fastener T moving in a downward direction. Such action is instigated by a reject signal received from the laser sensing device 75 and communicated to a solenoid 102 of a rotary door 104 of the rotatable door mechanism. Therefore, the threaded fastener delivered by the fingers 82 of the indexing stripper arm mechanism 80 to the slotted discharge rail 95 will be redirected off of the slotted discharge rail 95 by the peripheral portion 105 of the rotary door mechanism 100 if the solenoid 102 receives a signal from the laser sensing device 75 that the next threaded fastener T being inspected and carried by the stripper arm mechanism 80 to the slotted discharge rail 95 is a reject. The rotary door mechanism 100 moves the peripheral portion 105 into the slot 96 of the slotted discharge rail 95 to redirect rejected threaded fasteners to a collection bin 108 standing nearby. If the rotary door mechanism 100 is not actuated by any signal from the laser sensing mechanism 75, the threaded fastener T is allowed to travel the complete length of the slotted discharge rail 95 to a second storage bin 110 located at the end of the slotted discharge rail 95 to collect threaded fasteners whose threads have been functionally found to be acceptable in the test station 45 of the inspection device 10.

While the threaded fastener T is in the test position, additional dimensional characteristics may be selectively checked using additional laser sensing devices. For example, laser sensing devices to check the overall length of the threaded fastener, the head diameter, the location of the shoulder relative to either end of the bolt, etc., can easily be placed along the path of the threaded fastener to monitor dimensional characteristics. Upon finding an out of tolerance dimension a reject signal (like the reject signal of the functional test station) is generated and communicated to the rotatable door mechanism 100 so it may actuate to interfere with the fastener travelling down the slotted discharge rail and reject same if any one of these dimensional characteristics is not within the acceptable tolerance range as determined by the part print. Accordingly, each of these detecting devices are able to generate a signal to the rotatable door mechanism 100 mounted in the slotted discharge rail 95 in order to separate rejects from acceptable parts. Such additional dimensional checks are intended to be combined with the functional testing of the thread profile in order to provide a threaded member to the end user which completely complies with the end user's requirements.

The invention also contemplates the use of appropriate proximity sensors to ensure the existence of a continuous supply of threaded fasteners. Any interruption in the continuous flow of fasteners is sensed by these proximity sensors and an appropriate signal is generated to stop the device so that corrective action may be initiated.

While an operable embodiment of the invention has been described and illustrated, it will be understood that the invention is not limited thereto, since many modifications may be made and will become apparent to those skilled in the art. The reject mechanism has been described and associated with a preferred embodiment of the functional testing device. However, it is apparent that detection circuits operating differently can be used with the rejection scheme that has been described above and which is claimed in the claims.

What is claimed is:

1. An apparatus for functionally testing and sorting a plurality of threaded members, each threaded member having a threaded shank portion and a head portion, said apparatus comprising:

a base member;

a frame support means mounted to said base member, said frame support means having first rotatable transfer means attached thereto;

means for conveying said plurality of threaded members to said first rotatable transfer means, said conveying means being attached to said frame support means and having one end juxtaposed said first rotatable transfer means such that said first rotatable transfer means receives each threaded member of said plurality of threaded members one at a time from said one end of said conveying means at a predetermined pick-up area and rotatably transfers each said threaded member to a predetermined drop-off area;

second rotatable transfer means attached to said frame support means and spaced a predetermined distance from said first rotatable transfer means, said second rotatable transfer means having means for receiving each said threaded member from said first rotatable transfer means at said predetermined drop-off area, said second rotatable transfer means transferring each said threaded member from said predetermined drop-off area to a testing station;

means for functionally testing said threaded portion of said threaded member, said functional testing means being positioned to partially surround said threaded member located at said testing station, such that said functional testing means and said second rotatable transfer means communicate to position said threaded member at said testing station and functionally test said threaded portion of said threaded member; and means for selectively sorting each said threaded member tested by said functional testing means, said sorting means being attached to said frame support means and located in spaced relationship to said second rotatable transfer means such that rejects identified by said functional testing means are selectively separated from said plurality of threaded members that pass through said testing station.

2. The apparatus as claimed in claim 1 wherein said first rotatable transfer means comprises:

an escapement wheel mounted to said frame support means and adjacent said means for conveying said plurality of threaded members, said escapement wheel having a plurality of radially disposed notches in a peripheral portion thereof for receiving each of said plurality of threaded members one at a time from said conveying means and for discharging said threaded members therefrom; and means for driving said escapement wheel, said driving means being positioned in spaced relationship with said escapement wheel for rotatably driving said escapement wheel such that each of said plurality of radially disposed notches receives one of said plurality of threaded members one at a time to transfer said threaded members one at a time from said conveying means to said second rotatable transfer means.

3. The apparatus as claimed in claim 1 wherein said means for conveying said plurality of threaded members further comprises:

inclined parallel spaced guide rails juxtaposed said first rotatable transfer means forming said means for conveying for supplying each of said plurality of threaded members to said first rotatable transfer means by gravity; and means for serially orienting and supplying said plurality of threaded members such that said threaded members are conveyed to said first rotatable transfer means with said threaded portion suspended between said inclined parallel spaced guide rails and said head portion suspended above said inclined parallel spaced guide rails.

4. The apparatus as claimed in claim 1 wherein said first rotatable transfer means further comprises guide track means for guiding said threaded members one after another in a threaded shank down attitude in said radially disposed notches of said peripheral portion of said escapement wheel and wherein said means for driving said escapement wheel rotates said escapement wheel in a predetermined first direction.

5. The apparatus as claimed in claim 3 wherein said inclined parallel spaced guide rails define a groove therebetween, said groove having a width which is smaller than a diameter of said head portion of said threaded member and which is greater than a diameter of said threaded shank portion of said threaded member.

6. The apparatus as claimed in claim 1 wherein said second rotatable transfer means further comprises:

a regulator wheel mounted to said frame support means in spaced relation to said first rotatable transfer means for receiving said threaded members from said first rotatable transfer means;

said means for receiving further comprising means for holding said threaded member along a peripheral edge of said regulator wheel, said receiving and said holding means being integral with said regulator wheel; and means for driving said regulator wheel, said driving means located on said frame support means and having one end for mounting said regulator wheel in spaced relationship to said first rotatable transfer means, said driving means further rotatably driving said regulator wheel in a direction opposite to the rotational direction of said first rotatable transfer means such that said regulator wheel receives said threaded member from said first rotatable transfer means at said predetermined drop-off area while rotating and further holds said threaded member along a peripheral edge thereof while continuing to rotate in said rotational direction opposite to that of said first rotatable transfer means.

7. The apparatus as claimed in claim 6 wherein said regulator wheel further comprises at least two regulator wheels mounted to said one end in a spaced apart relationship and further wherein said means for holding further comprises means for holding said threaded member along a peripheral edge of each of said at least two regulator wheels.

8. The apparatus as claimed in claim 6 wherein said means for functionally testing said threaded shank portion of said threaded member further comprises:

first adjustable slide means mounted adjacent said regulator wheel, said first adjustable slide means having one end extending in a direction towards said second rotatable transfer means and an opposite end mounted to said frame support means;

at least one idling roller mounted to said one end of said first adjustable slide means;

second adjustable slide means mounted in spaced relation to said first adjustable slide means, said second adjustable slide means having one end portion extending in a direction towards said second rotatable transfer means and an opposite end mounted to said frame support means;

a master thread gage member mounted to said one end of said second adjustable slide means;

actuating first means for actuating said first adjustable slide means, said first actuating means being mounted to said frame support means whereby said first actuating means moves said first adjustable slide means in a first direction towards and away from said second rotatable transfer means and in a second direction transverse thereto;

second means for actuating said second adjustable slide means, said second actuating means being mounted to said frame support means whereby said second actuating means moves said second adjustable slide means in a first direction towards and away from said second rotatable transfer means and in a second direction transverse thereto whereby actuation of said first means for actuating moves said first adjustable slide means in a direction towards said second rotatable transfer means such that said at least one idling roller is moved to a position juxtaposed said second rotatable transfer means such that as said second rotatable transfer means rotates said threaded member to said testing station said at least one idling roller prevents further rotatable translation of said threaded member with said second rotatable transfer means and thereby causes said threaded member to start rotating about its longitudinal axis and further whereby subsequent actuation of said second means for actuating said second adjustable slide means moves said second adjustable slide means in a direction towards said threaded member such that said master thread gage member is moved into contact with the thread profile of said threaded member whereby said master thread gage member translates along the thread profile of said threaded member; and means for measuring the peripheral movement of said master thread gage member in a direction towards and away from said threaded member such that any internal defects to the thread profile of said threaded member may be measured by said means for measuring, said measuring means further comprising means for generating a reject signal upon movement of said master thread gage member in a direction towards and away from said threaded member beyond a predetermined distance.

9. A method for automatically and serially functionally testing and sorting a plurality of threaded members, each threaded member having a threaded portion, said method comprising the steps of:

serially placing said plurality of threaded members one at a time at a predetermined pick-up area on a first rotatable transfer means carried by a frame support mounted to a base member;

transferring each of said threaded members of said plurality of threaded members from said predetermined pick-up area to a second rotatable transfer means mounted to said frame support for serially moving each said threaded member to at least one test station;

functionally testing the threaded profile of each said threaded member by rotating each said threaded member of said plurality of threaded members while located in said test station in complementary engagement with a master thread gage;

monitoring said master thread gage for movement while engaged with said threaded portion of said threaded member to generate a control signal indicative of the accuracy of the thread of each said threaded member as compared to said master thread gage;

discharging said threaded member from said second rotatable transfer means into a discharge chute at a predetermined discharge area; and sorting each defective threaded member discharged on said discharge chute from said nondefective threaded members upon receiving said control signal.

* * * * *

UNITED STATES PATENT AND TRADEMARK OFFICE

CERTIFICATE OF CORRECTION

PATENT NO. : 5,823,356
DATED : October 20, 1998
INVENTOR(S) : Goodrich et al.

It is certified that error appears in the above-identified patent and that said Letters Patent is hereby corrected as shown below:

On the title page, item :

[54] Title, kindly delete "INSEPCTING" and insert

---- INSPECTING ----.

Column 1, Title, kindly delete "INSEPCTING" and insert

---- INSPECTING ----.

Column 7, line 21, kindly delete "slot" and insert ---- slotted guide ----.

Column 8, line 59, kindly delete "thread" and insert ---- threaded ----; same line kindly delete "threaded" and insert ---- thread ----.

Column 9, line 6, kindly delete "occur" and insert ---- occurs ----.

Column 10, line 38, kindly delete "discharge slotted" and insert

---- slotted discharge ----.

Column 12, line 17, after "; and" kindly insert ---- an additional paragraph indentation to indicate a sub-element ----.

Signed and Sealed this

Eighth Day of June, 1999

*Attest:*

Q. TODD DICKINSON

*Attesting Officer*

*Acting Commissioner of Patents and Trademarks*